US009168582B2

(12) United States Patent
Faoro

(10) Patent No.: US 9,168,582 B2
(45) Date of Patent: Oct. 27, 2015

(54) MACHINE FOR FORMING METAL BARS

(75) Inventor: Giovanni Faoro, Bassano del Grappa (IT)

(73) Assignee: IKOI S.R.L., Cassola (VI) (IT)

( * ) Notice: Subject to any disclaimer, the term of this patent is extended or adjusted under 35 U.S.C. 154(b) by 0 days.

(21) Appl. No.: 14/007,910

(22) PCT Filed: Mar. 29, 2012

(86) PCT No.: PCT/EP2012/001377

§ 371 (c)(1), (2), (4) Date: Oct. 17, 2013

(87) PCT Pub. No.: WO2012/130451

PCT Pub. Date: Oct. 4, 2012

(65) Prior Publication Data

US 2014/0041825 A1 Feb. 13, 2014

(30) Foreign Application Priority Data

Apr. 1, 2011 (IT) ..... VI2011A0076

(51) Int. Cl.

| | |
|---|---|
| ***B22D 7/00*** | (2006.01) |
| ***B22D 7/06*** | (2006.01) |
| ***B22D 9/00*** | (2006.01) |
| ***B22D 21/02*** | (2006.01) |
| ***B22D 23/06*** | (2006.01) |
| ***B22D 27/00*** | (2006.01) |
| ***B22D 47/00*** | (2006.01) |

(52) U.S. Cl.

CPC *B22D 7/005* (2013.01); *B22D 7/06* (2013.01); *B22D 7/064* (2013.01); *B22D 7/068* (2013.01); *B22D 9/00* (2013.01); *B22D 9/003* (2013.01); *B22D 21/025* (2013.01); *B22D 23/06* (2013.01); *B22D 27/003* (2013.01); *B22D 47/00* (2013.01)

(58) Field of Classification Search

CPC ..... B22D 7/005; B22D 7/06; B22D 7/064; B22D 7/068; B22D 9/00; B22D 9/003; B22D 23/06; B22D 27/003; B22D 47/00; B22D 21/025

USPC ..... 164/493, 338.1, 47, 122, 55.1, 405

See application file for complete search history.

(56) References Cited

U.S. PATENT DOCUMENTS

| | | | |
|---|---|---|---|
| 2001/0050157 | A1 | 12/2001 | Drowd |
| 2007/0289715 | A1 | 12/2007 | Crafton et al. |

FOREIGN PATENT DOCUMENTS

| | | |
|---|---|---|
| DE | 20012066 | 9/2000 |
| JP | 4 305359 | 10/1992 |

OTHER PUBLICATIONS

International Search Report in PCT/IT2010/000452 mailed Jul. 10, 2012.

Written Opinion of the International Searching Authority mailed Jul. 10, 2012.

*Primary Examiner* — Kevin P Kerns

*Assistant Examiner* — Steven Ha

(74) *Attorney, Agent, or Firm* — Collard & Roe, P.C.

(57) ABSTRACT

There is provided a machine for forming metal bars particularly suitable for melting and the subsequent continuous solidification of precious metal such as gold, silver, precious alloys, as well as other pure metals or different alloys, in the form of powder, grits or swarf of various sizes, for producing ingots having weights varying from 50 g to 50 kg. The machine having six operating stations arranged in succession.

17 Claims, 1 Drawing Sheet

MACHINE FOR FORMING METAL BARS

CROSS REFERENCE TO RELATED APPLICATIONS

This application is the National Stage of PCT/EP2012/001377 filed on Mar. 29, 2012, which claims priority under 35 U.S.C. §119 of Italian Application No. VI2011A000076 filed on Apr. 1, 2011, the disclosure of which is incorporated herein by reference. The international application under PCT article 21(2) was published in English.

The present invention relates to a machine for forming metal bars in particular suitable for melting and the subsequent continuous solidification of precious metal such as gold, silver, precious alloys, as well as other pure metals or different alloys, for producing ingots.

As known, producing ingots, in particular made of gold, silver, precious alloys, other pure metals and different alloys, is usually obtained by means of two different methods.

When producing light ingots, from 5 g up to 50 g, there is used a cold moulding and coining process, starting from semi-finished products, such as cylindrical-shaped preformed pads or billets.

When producing ingots with weight varying between 50 g and 50 Kg there is instead used the melting method and subsequent solidification of the metal in the special moulds.

In practice, the metal to be melted is placed within ladles, in form of powders, granules or loose raw materials of various sizes, wherein it is brought to melting.

Then the molten metal is poured in single ingot moulds, generally shaped to form a truncated-trapezoid wherein, solidifying, it takes the form of an ingot.

Such two operations, the melting one and the subsequent one for solidifying the material, must be carried out with special care, given that the obtained end-product must meet strict and specific standard requirements.

Actually the ingots available in the market, besides having an exact purity if made of pure metal, or an exact percentage of pure metal if made of an alloy (the so-called "count"), must have extremely precise dimensions and weight, an external configuration with regular surfaces, without depressions or cracks, a uniform coloration and, above all, they must have a perfect internal metal-graphic structure, without blowholes, microporosities and structural tensions.

In order to avoid obtaining faulty ingots not capable of allowing obtaining the "punching", which would thus be considered as waste material, it is necessary that the entire production cycle be carried out with a lot of care, in particular during the steps of melting, solidifying and cooling the metal.

According to the current state of the art, production of ingots occurs, besides manually, by using melting furnaces provided with a crucible from which the molten metal is poured into the ingot moulds, also using plants of considerable dimensions, wherein the main work steps are performed through a continuous automatic cycle.

The most important documents of the prior art are: JP 4 305359 A, US 2001/050157 A1, DE 200 12 066 U1 and US 2007/289715 A1.

An object of the present invention is to provide a machine for forming metal bars, in particular for producing ingots, made of precious and non-precious material and, which, though including the steps of melting and solidifying the material, does not have the drawbacks revealed by the plants of the known type.

Such object is attained by providing a machine, in which there are present six operating stations, arranged in succession wherein:

- in the first station, defined as the "loading area", there occurs the deposit of the solid metal in the ingot mould, the addition of a specific chemical additive, which interacts with the crystalline structure of the material, to prevent the formation of unevenness and internal tensions during the subsequent melting step, the positioning of the cover for closing the ingot mould and in which there is present a pushing device for moving all the ingot moulds forward over the entire operating cycle;
- in the second station, generally defined "melting furnace", there occurs the melting of the metal contained in the ingot mould, according to the predefined temperature/time parameters;
- in the third station, defined as a "secondary addition", there is deposited on the still liquid metal a chemical additive, which eliminates the unevenness that tends to form on the surfaces of the ingots during the subsequent solidification step".
- in the fourth station, defined "solidification area", there occurs the solidification of the metal in the ingot mould, according to the predefined temperature/time parameters;
- in the fifth station, defined "cooling area", there occurs the cooling of the solid ingot and in it, when there is required a quick cooling, the aforementioned is unloaded into a vat containing the cooling fluid, from which it is collected when it is completely cooled;
- in the sixth station, defined "unloading area", there are unloaded the ingot moulds, which may contain the ingots, in case of normal cooling, or they may be empty, in case of quick cooling and the cooled ingots are recovered separately.

The characteristics of the invention will be made clearer through the description of a possible embodiment thereof, provided by way of non-limiting example, with reference to the attached drawings, wherein.

Figures 1, 2, 3, 5:
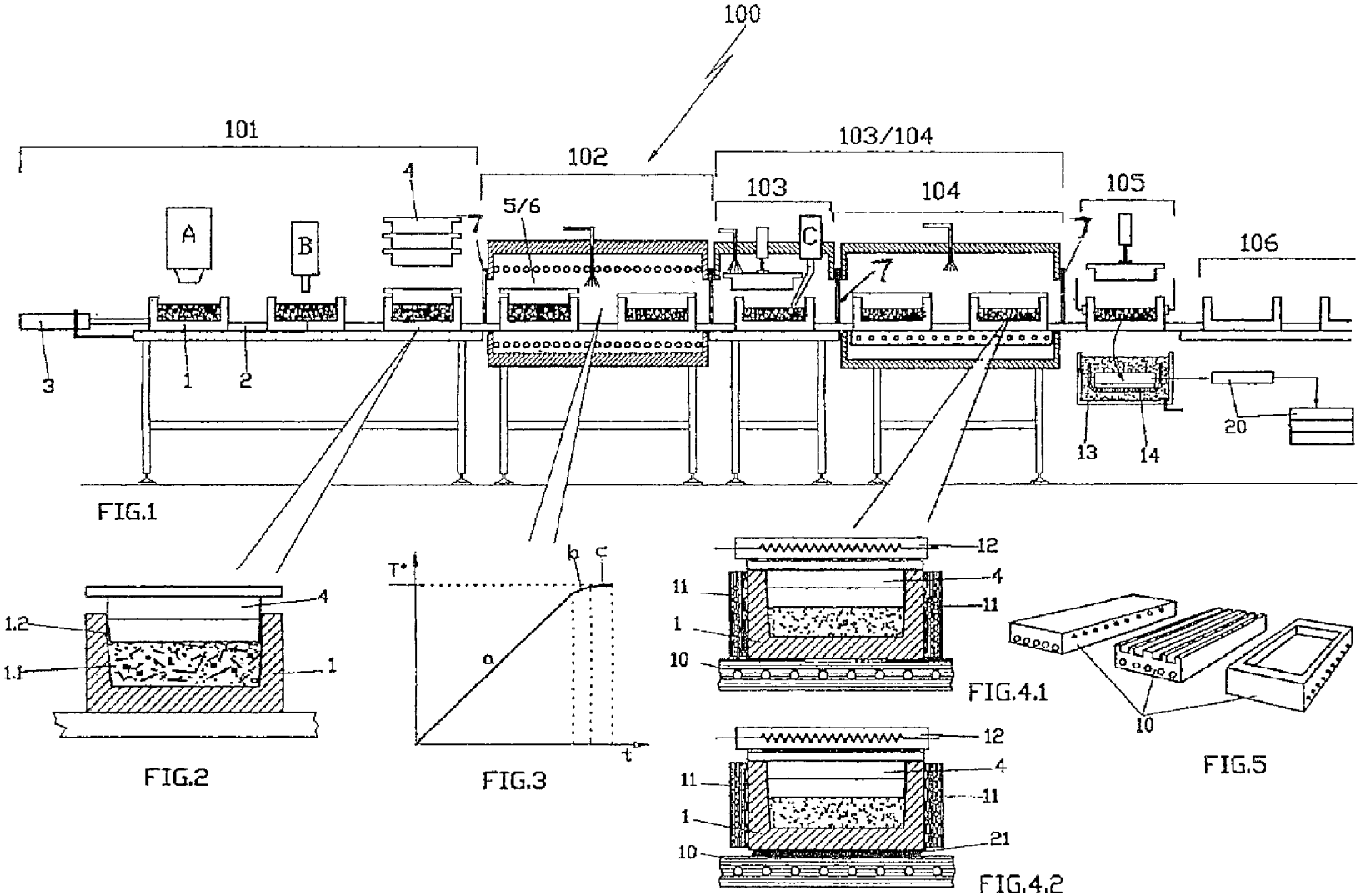
FIG. 1 represents an elevational view of the machine according to the invention.
FIG. 2 represents a detailed view of the ingot mould in the loading station.
FIG. 3 represents the t/T° (time/temperature) diagram in the metal melting station.

FIGS. 4.1 and 4.2 represent detailed views of the ingot mould, in the solidification station, with different cooling modes;

FIG. 5 represents three different configurations of the sliding plate of the ingot moulds, during the solidification step.

As observable from the figures, the machine according to the invention, generally indicated with reference 100, comprises:

- a station for loading and pushing, indicated with reference 101, the ingot moulds 1;
- a metal melting station contained in the ingot moulds, indicated with reference 102;
- a station for the "secondary addition" on the still liquid metal, indicated with reference 103;
- a station for solidifying the molten metal, indicated with reference 104;
- a station for cooling the solid ingot, indicated with reference 105;
- a station for unloading the ingot moulds, indicated with reference 106.

As can be seen in FIG. 1, on a loading surface of the first operating station 101 there are positioned the empty ingot moulds 1, interposing between an ingot mould and the subsequent one or between groups of two or more mutually adjacent ingot moulds, spacers 2, made of graphite or any other refractory material, which have the function of maintaining a predefined distance between the single ingot moulds or between the groups of ingot moulds, in a manner such that the ingot moulds 1, forming a "train of ingot moulds" are positioned, during the forward movement, always correctly within the work area; furthermore said operating surface is also provided with a pushing device 3, driven variously, such as by a worm screw, a pneumatic means, hydraulic means or any other means, which provides for pushing, with a predefined "pitch", the aforementioned train forward, and then returning and thus freeing space on the aforementioned loading surface, to allow depositing further empty ingot moulds.

From an operational point of view, in each single ingot mould 1 there is poured an exact weight of metal, in form of powder, grits or swarf of various sizes (pouring element "A") and there is added a chemical additive (dosing element "B"), which creates a chemical reaction with the impurities contained in the metal and which is made up of Boric acid, Borax, Potassium Nitrates, Ammonium, Sodium, lithium and Potassium and Sodium Chlorides, used separately or mixed.

Lastly, in said first station 101 there occurs the positioning of the cover 4 for closing the filled ingot mould.

From a constructional point of view, as can be seen in the detailed FIG. 2, the ingot mould 1 may have a dimension in height such that, when it is filled with the exact weight of metal, the cover 4 thereof rests on the metal, but remains raised with to respect to the abutment of the edge of the ingot mould, this allowing the bottom of the cover to compress and thus regularly compact the powders, the grits or the swarf so that, during the subsequent melting step, when the volume occupied by the mass of metal reduces gradually even up to one third of the initial solid volume, the cover lowers progressively as the metal melts, until it rests on the aforementioned abutment, thus hermetically closing the ingot mould.

Furthermore, the interior space of the ingot mould 1 is made up of two distinct volumes; the lower volume 1.1 constitutes the actual "mould", wherein there are determined the form and the dimensions of the ingot, according to the international standards, such as for example the LMBA standards, or with the other specific requirements of the client and a second upper volume 1.2, which can be differently configured, with the aim of facilitating the deposit of the metal during the loading step.

Then, the pushing device 3 pushes the "train" from the station 101 for supplying the ingot moulds to the melting station 102, wherein there may be a heating furnace 5, in which the ingot moulds and the spacers slide on a refractory surface in absence of controlled atmosphere, or a tunnel 6, in which the ingot moulds and the spacers slide on the surface of the tunnel or on guides, variously heated, through electrical resistors, by electromagnetic induction, through burners of the gas type or of any other type, up to the operating temperature; by way of example, regarding the ingots made of silver (Ag) such temperature is of about 1150° C. While for the ingots made of gold (Au) it is of about 1250° C. and in the tunnel or in the guides there is insufflated inert gas, such as nitrogen, nitrogen-hydrogen mixture with max. 4.5% of hydrogen (H), to create an "inert" environment, which prevents the ingot moulds and the covers from being subjected to oxidation and thus prevents a quick wear and keeps the molten metal protected from oxygen.

Practically, the difficulty of repetitively and constantly adjusting the melting temperature of the ingots within the tunnel is partly overcome by using the "induction" heating, wherein the increase of the heating temperature (thermal gradient) occurs with at least two ramps (FIG. 3), with a quick ramp (a), up to reaching at least 90% of the set value of the melting temperature and one or more ramps (b.c) with less inclined profile (see FIG. 3).

Furthermore, with the aim of reducing the heat and the atmosphere of the inert gas, within the tunnel 6 there is provided for, at the lateral openings for the inlet and outlet of the "train", the application of mobile partitions 7 obtained, for example, with the guillotine technique, which create a mobile or flexible insulating refractory barrier, the movement thereof being manual or automatic.

Then, still from an operational point of view, once the melting time elapses there is activated the pushing device 3, which provides for moving the "train" forward; the ingot moulds present on the loading surface are pushed into the furnace/tunnel 5/6 and the same, in turn, push the ingot moulds present in the tunnel/furnace 5/6 to exit, with the aim of allowing the latter, containing the molten metal, then pass in the station of "secondary addition" 103 and, subsequently, in the solidification station 104.

From an operational point of view, in the station 103 there occurs the raising of the cover of the ingot mould, by means of grippers of the mechanical type, pneumatic type or any other type, while dosing systems of the mechanical type, pneumatic type or any other type, add in each single ingot mould 1, on the molten metal, an accurate amount of chemical additive (dosing element "C"), which creates a chemical reaction with the impurities contained in the molten metal, the additive being made up of Boric acid, Borax, Potassium Nitrates, Ammonium, Sodium, Lithium and Potassium and Sodium Chlorides, used separately or mixed; subsequently the cover is repositioned on the ingot mould.

Also in the process of "secondary addition" there should be created an "inert" environment, regarding which there is introduced a flow of inert gas such as Nitrogen, Argon or Nitrogen-Hydrogen mixture, which prevents the oxidation of the ingot moulds and the covers and protects the metal still in liquid form against oxygen. Then, in the solidification station 104 the incandescent temperature ingot moulds, containing the molten metal and closed by the cover, slide until they stop on a cooling surface 10, cooled with water by means of passage holes present therewithin and made using copper, aluminium or alloys thereof or other materials suitable for the controlled dispersion of heat, in which they remain for a predefined period of time, averagely 1 to 5 minutes, as a function of the amount of material to be solidified, up to the complete solidification of the entire mass.

Also in the solidification process there should be created an "inert" environment, hence there is introduced a flow of inert gas such as Nitrogen, Argon or Nitrogen-Hydrogen mixture, which prevents the oxidation of the ingot moulds and the covers and protects the metal being solidified against oxygen.

Specifically, depending on the internal metal structure the ingot is required to obtain, which should have large, medium or small crystals and a more or less marked solidification shrinkage, the solidification station 104 may be provided with further insulating or refractory cooling plates for slowing the thermal dispersion 11; such plates may be possibly provided with notches for defining the localised heat areas, which are placed near or in contact with one or more sides of the ingot mould and of the cover (see FIG. 4.1), and/or further heating plates for slowing the cooling 21, made of graphite, metal or refractory or insulating materials, smooth or provided with suitable millings in relief or recessed, which may be placed between the cooling plate 10 and the ingot mould 1 (see FIG. 4.2).

Alternatively, when there is required an accurate control of the thermodynamic solidification gradients, with the aim of obtaining an ingot with the most suitable solidified metal structure the solidification station 104 may be provided with heating panels 12 for example heated using electrical resistors, gas or using any other means, also positioned around the ingot mould and on the cover.

Furthermore, with the aim of having a further possibility of accurately determining the thermodynamic gradients, depending on the internal metal structure the ingot is required to take, the cooling plate 10 may have the sliding surface—on which the ingot moulds stop in the solidification step—having a flat and smooth surface, or provided with millings in relief or recessed; furthermore the passage of the cooling fluid may be executed longitudinally and/or transversely to the direction of movement of the "trains" of ingot moulds (see FIG. 5).

Due to construction reasons, in some cases the "secondary addition" station 103 and the solidification station 104 may be incorporated in a single station 103/104, where there the addition and solidification steps are performed sequentially.

Subsequently, the ingot mould passes in the cooling station 105 and such operation may occur through two different operating modes, according to the set production times and as a function of the type of material and the "size" of the produced ingots. Specifically, the two cooling methods are:

normal cooling: the ingot moulds with the ingots still very hot are subjected to a controlled cooling in a free environment and thus they are sent to the unloading station 106.

quick cooling of the ingots: when the ingot moulds, with the solid ingots still very hot, are brought to the cooling area they are emptied and the ingots are dropped in a cooling water vat 13, while the empty ingot moulds are sent to the unloading station 106.

From an operational point of view, the quick cooling provides for the raising of the cover of the ingot mould, by means of grippers of the mechanical type, pneumatic type or any other type, while actuators of the mechanical type, pneumatic type or any other type lock the ingot mould at the base.

Then, the aforementioned actuators rotate and tilt the ingot mould and, by gravity, the hot ingot falls into a basket 14, submerged in the cooling vat 13 which after a suitable cooling time, through a translation movement, exits from the aforementioned vat to allow the collection of the cooled ingot 20.

Still subsequently, on the contrary, after the empty basket 14 returns, the repositioning of the empty ingot moulds and the lowering of the covers, the head pushing device 3 moves the "train" forward, so that the empty ingot mould, sliding, ends up positioned in the unloading station 106, from which it is collected together with the ingot 20.

In particular said unloading station 106 may be suitably extended, so as to allow the "train" of ingot moulds to remain exposed on the cooling surface over a long period of time, so as to be able to gradually reach a temperature suitable to allow an easy handling by the operator who should collect them empty (in case of quick cooling), or should remove the covers and collect the cooled ingots from the ingot moulds (in case of normal cooling).

The invention thus conceived can be subjected to numerous variants and modifications and the construction details thereof can be replaced by technically equivalent elements, all falling within the inventive concept defined by the following claims.

The invention claimed is:

1. A machine (100) for forming metal bars into the form of ingots having mass varying from 50 g to 50 kg adapted for melting and the subsequent continuous solidification of precious metal, including gold, silver, precious alloys, as well as other pure metals or different alloys, in the form of solid metal powder, grits or swarf of various sizes, said machine having six operating stations arranged in succession and including a pushing device (3) for moving ingot molds (1) over the machine operating stations, said machine operating stations comprising:

a) a first loading station (101) including a pouring element (A) for depositing the solid metal into each of said ingot molds (1), a first dosage element (B) adapted to add a first specific chemical additive which interacts with the crystalline structure of the metal, a positioner for a cover (4) for closing each of said ingot molds (1), and a spacer (2) formed of refractory material for maintaining a predetermined distance between ingot molds (1);

b) a second melting station (102) including a melting furnace where the metal contained in the ingot molds (1) is melted according to predefined temperature/time parameters;

c) a third station (103) including a second dosage element (C) adapted to add a second chemical additive on the melted metal contained in the ingot molds (1);

d) a fourth solidification station (104) including a cooling channel or a cooling bath where the solidification of the metal in the ingot molds (1) occurs according to the predefined temperature/time parameters;

e) a fifth cooling station (105) adapted for cooling the ingot molds (1) including as required a vat containing a cooling fluid, and adapted for collecting the ingots when completely cooled; and f) a sixth unloading station (106) for unloading the ingot molds (1) containing ingots or for unloading the ingot molds (1) from which ingots were removed for cooling in the cooling fluid vat of said fifth cooling station (105).

2. The machine for forming metal bars according to claim 1, wherein in the solidification station (104), a cooling plate (10) is provided having a sliding surface, on which the ingot molds stop in a solidification step, having a flat and smooth surface, or provided with millings in relief or recessed, the passage of cooling fluid being longitudinal and/or transverse to the direction of movement of the ingot molds.

3. The machine for forming metal bars according to claim 2, wherein in the solidification station (104), between the sliding surface of the cooling plate (10) and the ingot molds thereon, there are interposed other heating plates (21) for slowly cooling, made of graphite, metal or refractory or insulating materials, smooth or provided with suitable relief or recessed millings.

4. The operation of the machine for forming metal bars according to claim 3, wherein in the solidification station (104) there are present cooling or thermal insulation plates (11), provided with notches for defining localized heat areas, which are placed adjacent to one or more sides of each of the ingot molds and the cover thereof, there is also provided, when control of the thermodynamic solidification gradients is required for obtaining an ingot with suitable solidified metal structure, the addition of heating panels (12) of the electrical resistor type, gas-type or heated with other means, also positioned around each of the ingot molds and on the cover thereof.

5. The operation of the machine for forming metal bars according to claim 3, wherein quick cooling of ingots includes raising of the cover (4) of each of the ingot molds (1), by means of grippers of the mechanical type, pneumatic type or other type, and actuators of the mechanical type, pneumatic type or other type hold the ingot molds; then the actuators rotate and tilt the ingot molds and, by gravity, the hot ingots fall into a basket (14), which is submerged in a cooling vat (13).

6. The operation of the machine for forming metal bars according to claim 5, wherein after a cooling time, through a translation movement, the basket (14) exits from the vat (13), allowing collection of a cooled ingot (20) and the empty basket (14) is repositioned in the vat (13), and the pushing device (3) moves the ingot molds forward, so that the empty ingot molds are positioned in the unloading station (106), where they are collected together with each cooled ingot (20).

7. The operation of the machine for forming metal bars (100), according to claim 1, including in the first loading station (101), on a loading surface positioning empty ingot molds (1), interposing between ingot molds (1) spacers (2), made of refractory material, which have the function of maintaining a predefined distance between ingot molds so that the ingot molds (1), forming a train of ingot molds, are positioned, during forward movement, always correctly within the subsequent operating stations, wherein pushing device (3), driven by a worm screw, pneumatic means, hydraulic means or other means, provides for advancing, with a predefined pitch, the train of ingot molds forward, and then returning and thereby freeing space on the loading surface, to allow depositing further empty ingot molds.

8. The operation of the machine for forming metal bars according to claim 7, wherein in the first operating station (101), in each of the ingot molds (1), there is poured an exact weight of metal, in the form of powder, grits or swarf of various sizes by pouring element A and there is added a first chemical additive by first dosage element B, which creates a chemical reaction with the impurities contained in the metal and which is selected from the group consisting of boric acid, borax, potassium nitrates, ammonium, sodium, lithium and potassium and sodium chlorides, and combinations thereof and then cover (4) is positioned for closing each of the ingot molds filled with metal.

9. The operation of the machine for forming metal bars, according to claim 8, wherein each of the ingot molds (1) has a height dimension such that, when it is filled with the exact weight of metal, the cover (4) thereof may rest on the metal, but remain raised with respect to an abutting edge of each of the ingot molds, allowing the bottom of the cover to compress and thus compact the powders, the grits or the swarf, so that, during the subsequent melting step, when the volume occupied by the metal reduces gradually, even up to one third of the initial solid volume, the cover lowers progressively as the metal melts, until it rests on said abutting edge, thus hermetically closing each of said ingot molds, each of said ingot molds (1) having an internal space made up of two distinct volumes, a lower volume (1.1) constitutes the actual mold, wherein there are determined the form and the dimensions of the ingot, according to an international LMBA standard or other specific requirements and a second upper volume (1.2), which is configured to facilitate the deposit of metal during loading of the metal.

10. The operation of the machine for forming metal bars according to claim 9, wherein said pushing device (3) moves the train of ingot molds from the loading station (101) to supply the ingot molds (1) to the melting station (102), wherein there is a heating furnace (5), in which the ingot molds (1) and the spacers (2) slide on a refractory surface in the absence of a controlled atmosphere.

11. The operation of the machine for forming metal bars according to claim 10, wherein said pushing device (3) moves the train of ingot molds from the loading station (101) to supply the ingot molds (1) to melting station (102), wherein there is a tunnel (6), heated using induction heating, the increase of heating temperature or thermal gradient, occurring with a first ramp (a), reaching at least 90% of the set value of the melting temperature and one or more additional ramps (b, c) with a less inclined thermal gradient, wherein there is insufflated inert gas, creating an inert environment, there being provided, at the lateral openings for the inlet and outlet of the train of ingot molds, mobile partitions (7) obtained with a guillotine technique.

12. The operation of the machine for forming metal bars according to claim 11, wherein once the melting time elapses, the pushing device (3) moves the train of ingot molds forward so that the ingot molds present on the loading surface are pushed into the furnace/tunnel (5/6) and these in turn push the ingot molds present in the tunnel/furnace (5/6) to exit, then pass in the secondary addition station (103), wherein in each of said ingot molds (1) there is added to the molten metal a second chemical additive by dosage element C, which creates a chemical reaction with the impurities contained in the molten metal and which is selected from the group consisting of boric acid, borax, potassium nitrates, ammonium, sodium, lithium and potassium and sodium chlorides, and combinations thereof.

13. The operation of the machine for forming metal bars according to claim 11, wherein in the solidification station (104) the ingot molds containing the molten metal and closed by the cover slide until they stop on a cooling surface (10), cooled with water by means of passage holes present therewithin and made using copper, aluminum or alloys thereof or other materials suitable for the controlled dispersion of heat, in which they remain for a predefined period of time, as a function of the amount of material to be solidified, up to the complete solidification of the entire mass and in which there is created an inert environment with introduction of a flow of inert gas which prevents oxidation of the ingot molds and each cover thereof and protects the metal being solidified against oxygen.

14. The operation of the machine for forming metal bars according to claim 11, wherein the operations described in connection with the third station (103) and the solidification station (104) are carried out in a single operating station (103/104).

15. The operation of the machine for forming metal bars according to claim 11, wherein in the cooling station (105) the ingot molds are subjected to a controlled cooling in a free environment and they are then sent to the unloading station (106).

16. The operation of the machine for forming metal bars, according to claim 11, wherein in the cooling station (105) there is obtained cooling whereby the ingot molds with the solid ingots still hot, when they are in the cooling area, are emptied and the ingots fall into a cooling water vat (13), while the empty ingot molds are sent to the unloading station (106).

17. The operation of the machine for forming metal bars, according to claim 11, wherein said insufflated inert gas is nitrogen or a nitrogen-hydrogen mixture with a maximum of 4.5% hydrogen.

* * * * *